US011673720B2

(12) United States Patent
Noveletsky

(10) Patent No.: US 11,673,720 B2
(45) Date of Patent: Jun. 13, 2023

(54) CONTAINER LID WITH ROTATABLE SIPPER AND FLEXIBLE HANDLE

(71) Applicant: Cool Gear International, LLC, Plymouth, MA (US)

(72) Inventor: Tyler Noveletsky, North Easton, MA (US)

(73) Assignee: Cool Gear International, LLC, Plymouth, MA (US)

( * ) Notice: Subject to any disclaimer, the term of this patent is extended or adjusted under 35 U.S.C. 154(b) by 255 days.

(21) Appl. No.: 16/722,154

(22) Filed: Dec. 20, 2019

(65) Prior Publication Data

US 2020/0216232 A1 Jul. 9, 2020

Related U.S. Application Data

(60) Provisional application No. 62/787,894, filed on Jan. 3, 2019.

(51) Int. Cl.
*B65D 47/20* (2006.01)
*B65D 43/02* (2006.01)
(Continued)

(52) U.S. Cl.
CPC ..... *B65D 47/2006* (2013.01); *B65D 25/2852* (2013.01); *B65D 43/0231* (2013.01);
(Continued)

(58) Field of Classification Search
CPC ..... B65D 47/2006; B65D 25/2852; B65D 43/0231; B65D 2525/282; B65D 47/305;
(Continued)

(56) References Cited

U.S. PATENT DOCUMENTS 4,213,310 A 7/1980 Buss
D262,856 S 2/1982 Mactavish
(Continued)

FOREIGN PATENT DOCUMENTS

AU 2004100578 9/2004
AU 2004201562 10/2005
(Continued)

OTHER PUBLICATIONS

Young, Lee, International Search Report and Written Opinion issued in application No. PCT/2019US/067742, dated Mar. 19, 2020, 13 pages.
(Continued)

*Primary Examiner* — Jennifer Robertson
*Assistant Examiner* — John Martin Hoppmann
(74) *Attorney, Agent, or Firm* — Dinsmore & Shohl LLP

(57) ABSTRACT

A container lid can include: a body having an opening formed therethrough; a sipping member rotatably coupled to the body, a passageway formed through an interior of the sipping member so as to extend from a proximal end of the sipping member to a distal end of the sipping member, the sipping member configured to rotate between a stowed position in which the passageway and the opening are misaligned, such that the opening is sealed, and a released position in which the passageway and the opening are aligned; and a flexible handle connected at a first end to the sipping member and rotatably coupled at a second end to the body via a pivot pin. The handle can be configured such that a substantially downward force exerted on the handle causes rotation of the sipping member toward the released position.

19 Claims, 4 Drawing Sheets

(51) Int. Cl.
*B65D 25/28* (2006.01)
*B65D 47/06* (2006.01)

(52) U.S. Cl.
CPC ..... *B65D 47/065* (2013.01); *B65D 47/066* (2013.01); *B65D 2525/282* (2013.01)

(58) Field of Classification Search
CPC ..... B65D 51/242; B65D 2543/00046; B65D 2231/022; B65D 2543/00231; B65D 23/108; B65D 23/106; B65D 25/2861; B65D 25/2864; B65D 25/285; B65D 2251/1075; B65D 2251/1083; B65D 2251/0025; B65D 2251/009; B65D 47/065; B65D 51/18; B65D 2251/0028; B65D 43/26; B65D 45/025; B65D 47/06; B65D 2517/0049; B65D 47/20; B65D 47/066; B65D 51/24; B65D 77/283; B65D 77/286; B65D 77/28; A45F 3/16; A45F 5/02; A47G 19/2272; A47G 19/2222; A47G 21/18; A47G 19/2266; A47G 2200/048; A47G 2400/12; A47G 19/2255; A47G 19/2261; A47G 23/0241; A47G 21/186; G09B 19/003; A61J 11/00; A61J 9/005; A61J 9/00; A61J 9/0623; A61J 9/085; A61J 9/006
USPC ..... 215/226, 235, 239, 200, 388, 229; 222/274, 475, 475.1, 469, 470, 472, 473, 222/517, 465.1; 85/3.42, 3.09, 3.44; 220/212.5, 837, 484, 556, 557, 560, 220/254.3, 715, 262, 263, 318, 814, 708, 220/705
See application file for complete search history.

(56) References Cited

U.S. PATENT DOCUMENTS

| | | | | |
|---|---|---|---|---|
| D268,469 | S | 4/1983 | Ruxton | |
| D279,346 | S | 6/1985 | Ruxton | |
| D294,325 | S | 2/1988 | Fiore, Jr. | |
| D338,130 | S | 8/1993 | Costello | |
| 5,273,172 | A | 12/1993 | Rossbach et al. | |
| 5,465,866 | A | 11/1995 | Belcastro | |
| 5,735,438 | A * | 4/1998 | Ostrowsky | B65D 47/0866 222/498 |
| 5,964,365 | A | 10/1999 | Peeples | |
| 6,164,484 | A | 12/2000 | Fiore | |
| 6,276,560 | B1 | 8/2001 | Belcastro | |
| 6,279,773 | B1 | 8/2001 | Kiyota | |
| 6,494,056 | B1 | 12/2002 | Roth | |
| 6,523,711 | B1 | 2/2003 | Hughes et al. | |
| 6,584,800 | B1 | 7/2003 | Roth | |
| D478,469 | S | 8/2003 | Roth | |
| 6,601,403 | B1 | 8/2003 | Roth | |
| D485,468 | S | 1/2004 | Roth | |
| D511,435 | S | 11/2005 | Roth | |
| D512,875 | S | 12/2005 | Maldonado | |
| D518,335 | S | 4/2006 | Stuart | |
| 7,082,784 | B2 | 8/2006 | Roth | |
| D549,048 | S | 8/2007 | Duke | |
| D624,361 | S | 9/2010 | Roth | |
| 7,866,183 | B2 | 1/2011 | Roth | |
| D634,158 | S | 3/2011 | Roth | |
| D634,161 | S | 3/2011 | Roth | |
| 7,997,099 | B2 | 8/2011 | Roth | |
| 8,051,674 | B2 | 11/2011 | Roth | |
| 8,061,158 | B2 | 11/2011 | Roth | |
| 8,276,776 | B2 | 10/2012 | Roth | |
| 8,408,414 | B2 | 4/2013 | Roth | |
| 8,544,676 | B2 | 10/2013 | Roth | |
| D696,906 | S | 1/2014 | Roth | |
| 8,672,174 | B1 | 3/2014 | McMullin | |
| 8,777,039 | B2 | 7/2014 | Roth | |
| RE45,055 | E | 8/2014 | Roth | |
| D738,163 | S | 9/2015 | Roth | |
| 9,380,898 | B2 | 7/2016 | Mason | |
| 9,573,738 | B1 * | 2/2017 | Lai | B65D 47/305 |
| D804,903 | S | 12/2017 | Mason | |
| D804,904 | S | 12/2017 | Noveletsky | |
| 9,944,438 | B2 | 4/2018 | Roth | |
| 10,077,143 | B2 | 9/2018 | Roth | |
| 10,196,182 | B2 | 2/2019 | Roth | |
| D874,217 | S | 2/2020 | Tsai | |
| 2002/0040909 | A1 | 4/2002 | Goto et al. | |
| 2003/0196448 | A1 | 10/2003 | Roth | |
| 2005/0258201 | A1 * | 11/2005 | Willows | B65D 25/22 224/148.4 |
| 2006/0185384 | A1 | 8/2006 | Roth | |
| 2008/0078200 | A1 | 4/2008 | Roth | |
| 2008/0078787 | A1 * | 4/2008 | Yelland | A45F 5/02 224/148.1 |
| 2008/0217284 | A1 | 9/2008 | Roth | |
| 2010/0193462 | A1 | 8/2010 | Roth | |
| 2011/0198361 | A1 | 8/2011 | Chen | |
| 2012/0181277 | A1 * | 7/2012 | Wang-Wu | B65D 47/305 220/212 |
| 2012/0234789 | A1 * | 9/2012 | Mason | B65D 47/36 215/229 |
| 2012/0285961 | A1 | 11/2012 | Roth | |
| 2013/0214006 | A1 | 8/2013 | Roth | |
| 2015/0307265 | A1 * | 10/2015 | Winn | C02F 1/002 426/66 |
| 2016/0001933 | A1 | 1/2016 | Roth | |
| 2016/0120343 | A1 | 5/2016 | Liang | |
| 2016/0296051 | A1 | 10/2016 | Lane et al. | |
| 2017/0015462 | A1 | 1/2017 | Roth | |
| 2017/0050775 | A1 | 2/2017 | Sanbar | |
| 2017/0050785 | A1 | 2/2017 | Roth | |
| 2017/0144809 | A1 | 5/2017 | Sorensen et al. | |
| 2017/0340148 | A1 | 11/2017 | Chen et al. | |
| 2018/0050850 | A1 | 2/2018 | Murosky et al. | |
| 2019/0135502 | A1 | 5/2019 | Tsai | |
| 2020/0055646 | A1 | 2/2020 | DeKeyser | |
| 2020/0148431 | A1 | 5/2020 | Tsai | |
| 2020/0216218 | A1 | 7/2020 | Sanbar | |
| 2020/0216232 | A1 | 7/2020 | Noveletsky | |
| 2020/0367678 | A1 | 11/2020 | Harris | |

FOREIGN PATENT DOCUMENTS

| | | |
|---|---|---|
| AU | 328776 | 12/2009 |
| AU | 2010200265 | 8/2010 |
| AU | 2011332161 | 5/2013 |
| AU | 2016201471 | 4/2016 |
| AU | 2014368954 | 6/2016 |
| AU | 2015218686 | 9/2016 |
| AU | 1491016 | 11/2016 |
| AU | 1491116 | 11/2016 |
| AU | 1644816 | 11/2016 |
| AU | 1644916 | 11/2016 |
| AU | 2015259105 | 11/2016 |
| AU | 2015259182 | 11/2016 |
| AU | 2015259183 | 11/2016 |
| AU | 2017204758 | 7/2017 |
| AU | 2017226173 | 9/2018 |
| AU | 2017226178 | 9/2018 |
| AU | 2017354038 | 5/2019 |
| AU | 2018309062 | 2/2020 |
| AU | 2019376154 | 3/2021 |
| CA | 51305 | 5/1983 |
| CA | 2292400 | 6/2000 |
| CA | 2470906 | 6/2005 |
| CA | 132268 | 6/2010 |
| CA | 135424 | 6/2010 |
| CA | 135425 | 6/2010 |
| CA | 2691193 | 8/2010 |
| CA | 2817042 | 5/2012 |
| CA | 2900674 | 9/2014 |
| CA | 2933614 | 6/2015 |
| CA | 2939634 | 8/2015 |

(56) References Cited

FOREIGN PATENT DOCUMENTS

| | | | |
|---|---|---|---|
| CA | 2948174 | | 11/2015 |
| CA | 2948176 | | 11/2015 |
| CA | 2948180 | | 11/2015 |
| CA | 3016564 | | 9/2017 |
| CA | 3042043 | | 5/2018 |
| CA | 170355 | | 9/2018 |
| CA | 170356 | | 9/2018 |
| CA | 178839 | | 9/2018 |
| CA | 178861 | | 9/2018 |
| CA | 172791 | | 1/2019 |
| CA | 3070466 | | 2/2019 |
| CA | 3112845 | | 5/2020 |
| CN | 101798009 | | 8/2010 |
| CN | 201770189 | | 3/2011 |
| CN | 1013129824 | A | 6/2013 |
| CN | 106170444 | | 11/2016 |
| CN | 106414265 | | 2/2017 |
| CN | 106458385 | | 2/2017 |
| CN | 106660672 | | 5/2017 |
| CN | 207803967 | U | 9/2018 |
| CN | 109068879 | | 12/2018 |
| CN | 109071073 | | 12/2018 |
| CN | 109744820 | | 5/2019 |
| CN | 110997512 | | 4/2020 |
| CN | 112996411 | | 6/2021 |
| DK | 2958818 | | 10/2017 |
| EP | 2958818 | | 12/2015 |
| EP | 3107814 | | 12/2016 |
| EP | 3142941 | | 3/2017 |
| EP | 2958818 | B1 | 7/2017 |
| EP | 3142939 | | 11/2017 |
| EP | 3142940 | | 12/2017 |
| EP | 3257778 | | 12/2017 |
| EP | 3083443 | | 6/2018 |
| EP | 3534757 | | 9/2019 |
| EP | 3423372 | | 3/2020 |
| EP | 3661853 | | 6/2020 |
| EP | 3876785 | | 9/2021 |
| ES | 2642832 | | 11/2017 |
| GB | 2442593 | | 2/2009 |
| GB | 2467629 | | 8/2010 |
| GB | 2477219 | | 7/2011 |
| GB | 2475189 | | 9/2011 |
| GB | 2482766 | | 2/2012 |
| GB | 2493790 | A | 2/2013 |
| GB | 2528619 | | 1/2016 |
| HK | 1157301 | | 11/2012 |
| HK | 1167376 | | 3/2013 |
| HR | P20171530 | | 2/2018 |
| JP | H04294751 | A | 10/1992 |
| JP | 2003312706 | | 11/2003 |
| JP | 2008120456 | | 5/2008 |
| JP | 2014500835 | | 1/2014 |
| JP | 2017504532 | | 2/2017 |
| JP | 2017509555 | | 4/2017 |
| JP | 2017518928 | | 7/2017 |
| JP | 2017518929 | | 7/2017 |
| JP | 2017520483 | | 7/2017 |
| JP | 2019506983 | | 3/2019 |
| JP | 2019507710 | | 3/2019 |
| KR | 1020030064663 | | 8/2003 |
| KR | 1020160102033 | | 8/2016 |
| KR | 1020170007389 | | 1/2017 |
| KR | 1020170007393 | | 1/2017 |
| KR | 1020170009900 | | 1/2017 |
| KR | 1020180107285 | | 10/2018 |
| KR | 1020180116426 | | 10/2018 |
| KR | 1020200027572 | | 3/2020 |
| KR | 1020210089660 | | 7/2021 |
| MX | PA03001327 | | 7/2005 |
| MX | 2016008030 | | 10/2016 |
| MX | 2016014799 | | 3/2017 |
| MX | 2016014803 | | 3/2017 |
| MX | 2016014804 | | 3/2017 |
| MX | 2018010638 | | 5/2019 |
| MX | 2018010641 | | 6/2019 |
| PL | 2958818 | | 3/2018 |
| SI | 2958818 | | 12/2017 |
| WO | WO2008112504 | | 9/2008 |
| WO | WO-2009010087 | A1 * | 1/2009 ..... A47G 19/2272 |
| WO | WO2012071218 | | 5/2012 |
| WO | WO-2013096809 | A2 * | 6/2013 ..... B65D 83/206 |
| WO | WO2014137582 | | 9/2014 |
| WO | WO2015095776 | | 6/2015 |
| WO | WO2015127373 | | 8/2015 |
| WO | WO2015175689 | | 11/2015 |
| WO | WO2015175716 | | 11/2015 |
| WO | WO2015175717 | | 11/2015 |
| WO | WO2015175723 | | 11/2015 |
| WO | WO-2017146625 | A1 * | 8/2017 ..... A47J 43/27 |
| WO | WO2017152016 | | 9/2017 |
| WO | WO2017152021 | | 9/2017 |
| WO | WO2018085412 | | 5/2018 |
| WO | WO2019028326 | | 2/2019 |
| WO | WO2020097501 | | 5/2020 |
| WO | WO2020142252 | | 7/2020 |

OTHER PUBLICATIONS

U.S. Appl. No. 62/787,894 titled "Container Lid With Rotatable Sipper and Flexible Handle", filed Jan. 3, 2019.

PCT Patent Application No. PCT/US2019/067742 titled "Container Lid With Rotatable Sipper and Flexible Handle" filed on Dec. 20, 2019.

International Preliminary Report on Patentability issued in PCT Patent Application No. PCT/US2019/067742 dated Jul. 15, 2021.

Mexican Patent Application No. MX/a/2021/008077 titled "Container Lid With Rotatable Sipper and Flexible Handle" filed on Jan. 7, 2021.

Korean Patent Application No. 10-2021-7020884 titled "Container Lid With Rotatable Sipper and Flexible Handle" filed on Aug. 3, 2021.

Japanese Patent Application No. 2021-539133 titled "Container Lid With Rotatable Sipper and Flexible Handle" filed on Jul. 5, 2021.

European Patent Application No. 19907503.7 titled "Container Lid With Rotatable Sipper and Flexible Handle" filed on Aug. 3, 2021.

Extended European Search Report issued in European Patent Application No. 19907503.7 dated Oct. 5, 2022.

Chinese Patent Application No. 201980086850.9 titled "Container Lid With Rotatable Sipper and Flexible Handle" filed on Jun. 28, 2021.

Canada Patent Application No. 3122313 titled "Container Lid With Rotatable Sipper and Flexible Handle" filed on Jun. 4, 2021.

Australia Patent Application No. 2019418426 titled "Container Lid With Rotatable Sipper and Flexible Handle" filed on Jun. 1, 2021.

U.S. Appl. No. 62/787,894, filed Dec. 20, 2019 titled Container Lid With Rotatable Sipper and Flexible Handle.

Office Action issued in Chinese Application No. 201980086850.9 dated Apr. 28, 2022, 17 pages including English translation.

Office Action issued in Chinese Patent Application No. 201980086850.9 dated Dec. 13, 2022.

* cited by examiner

CONTAINER LID WITH ROTATABLE SIPPER AND FLEXIBLE HANDLE

CROSS-REFERENCE TO RELATED APPLICATIONS

This application claims priority to U.S. Provisional Patent Application No. 62/787,894, titled "Container Lid With Rotatable Sipper And Flexible Handle," filed Jan. 3, 2019, the entirety of which is incorporated by reference herein.

TECHNICAL FIELD

The present disclosure relates generally to container lids, and more particularly, to a container lid with a rotatable sipper and flexible handle.

BACKGROUND

Container lids can include mechanisms, such as caps (e.g., a screw-on cap, a flip cap, a push cap, etc.), for sealing an opening of a container through which fluid may enter and/or exit. To access fluid within the container while the container lid engages the container, a user can typically move or remove the cap relative to the opening of the container such that a fluid path into the container may be provided, allowing the user to drink through the lid. When the user wishes to seal the container (e.g., for transport), the user can move the cap such that the fluid path is sealed. Ideally, the cap seals the fluid path in a leak-proof manner so that leakage of fluid within the container is prevented.

A wide range of container lid designs exist. Some designs include a sipping member, or "sipper," which operates akin to a straw through which a user can drink fluid contained inside of the container. Other designs include a handle protruding from the lid to enable the container to be carried when the lid and container are coupled together. However, there is a need for a container lid which incorporates both a sipping member and a handle to achieve an enhanced degree of usability, portability, and convenience.

SUMMARY

The present disclosure provides a container lid with a rotating sipping member coupled to a flexible handle for convenient transport of the lid and container. When the sipping member is stowed away, a user can carry the container, coupled to the lid, by the handle without the sipping member releasing. Upon exerting a substantially downward force (e.g., push, pull, etc.) on the handle, the sipping member can release and rotate to a released position.

According to embodiments of the present disclosure, a container lid can include: a body having an opening formed therethrough and a thread pattern formed thereon for reversibly mating the container lid to a container, the opening in fluid communication with an interior of the container; a sipping member rotatably coupled to the body, a passageway formed through an interior of the sipping member so as to extend from a proximal end of the sipping member to a distal end of the sipping member, the sipping member configured to rotate between a stowed position in which the passageway and the opening are misaligned, such that the opening is sealed, and a released position in which the passageway and the opening are aligned; and a flexible handle connected at a first end to the sipping member and rotatably coupled at a second end to the body via a pivot pin. The handle can be configured such that a substantially downward force exerted on the handle causes rotation of the sipping member toward the released position.

The handle can be configured such that, when the sipping member is in the stowed position, the sipping member remains in the stowed position in response to a substantially upward or lateral force exerted on the handle.

When the sipping member is in the released position, the passageway of the sipping member and the opening can define a fluid path through which a fluid disposed in the interior of the container can exit the container. When the sipping member is in the stowed position, the fluid path defined by the passageway of the sipping member and the opening can be obstructed.

When the sipping member is in the stowed position, the opening can be sealed by a portion of a body of the sipping member.

The handle can be configured such that the downward force exerted on the handle further causes rotation of the handle about the pivot pin.

Rotation of the sipping member from the stowed position to the released position can cause the handle to rotate about the pivot pin approximately 90 degrees.

Rotation of the sipping member from the released position to the stowed position can increase a size of a carrying space defined by the handle and an outer portion of the body.

When the sipping member is in the released position, at least one of a portion of the sipping member and a portion of the handle can be configured to come into contact with an outer surface of the body, preventing further rotation of the sipping member away from the stowed position.

The first end of the handle can be co-injected with a portion of the sipping member.

The first end of the handle can include a protrusion portion having a surface level raised above that of an adjacent portion of the handle.

An upper surface of the protrusion portion can be surrounded entirely by a portion of the sipping member.

The first end of the handle can be positioned above the second end of the handle when the container lid is oriented in an upright manner.

The container lid can further include an indentation portion formed into the upper surface of the body, the indentation portion defining an interior receiving space configured to receive a portion of the sipping member. Additionally, the container lid can further include support arms extending outwardly from opposite sides of the sipping member, respectively, and disposed at least partially inside of the indentation portion. The sipping member can be rotatably coupled to the body via the support arms such that the sipping member is configured to rotate about the support arms. The support arms can be integral with the sipping member.

The indentation portion further can define support arm receiving spaces configured to receive the support arms. Also, when the sipping member is in the stowed position, the indentation portion is configured to receive the sipping member such that an upper surface of the sipping member is substantially flush with an upper surface of the body.

The thread pattern can be formed on an interior surface of the body.

The sipping member can be made of a polypropylene-based material, and the handle can be made of a silicon-based material or a thermoplastic rubber-based material.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1:
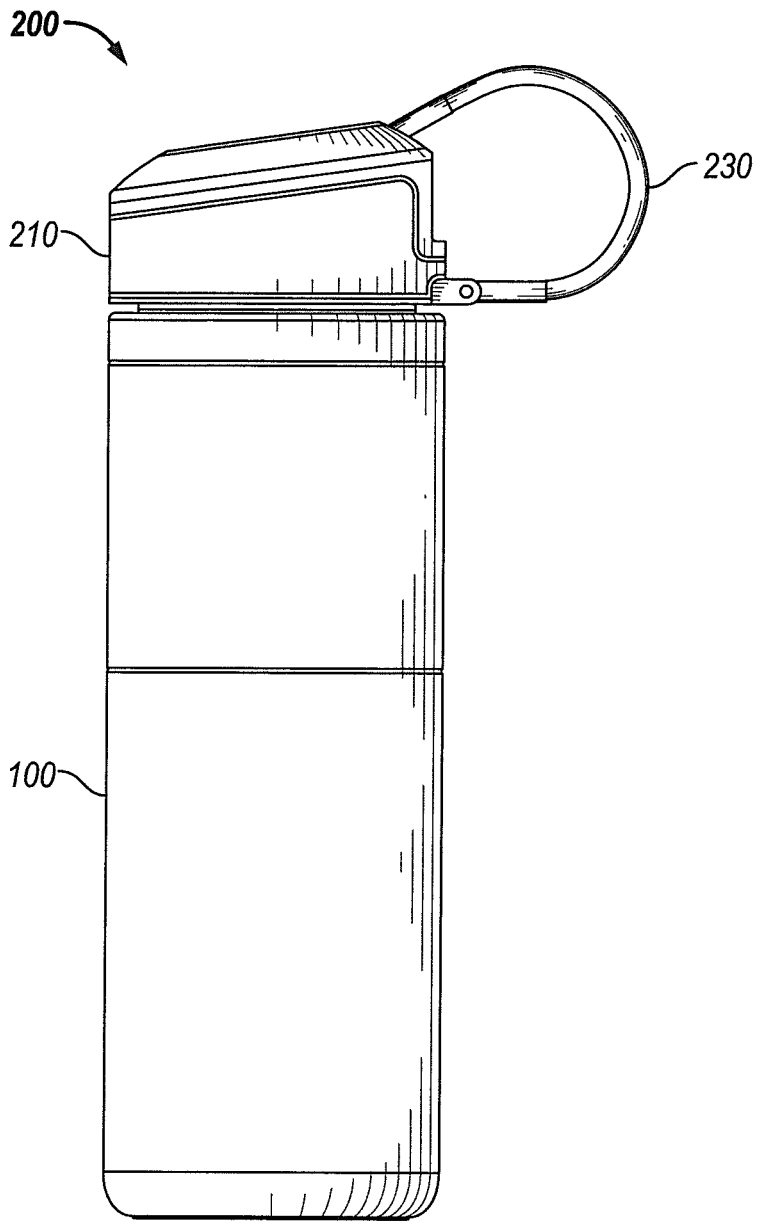
FIG. 1 is a side view of a container coupled to a lid with a rotatable sipping member in a stowed position.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to embodiments of the present disclosure, the disclosed container lid can include a sipping member, or "sipper," coupled to a flexible handle for convenient transport. The sipping member can rotate between a stowed position, in which the sipping member is stowed within an indentation portion formed in an upper surface of the lid, and a released position, in which a user can sip fluid contained inside of a container. While the sipping member is stowed, the user can carry the lid by handle, exerting a substantially upward force on the handle, and the sipping member can remain stowed. To release the sipping member, the user can downwardly push or pull the handle, thereby rotating the sipping member to a released position.

Figure 2A:
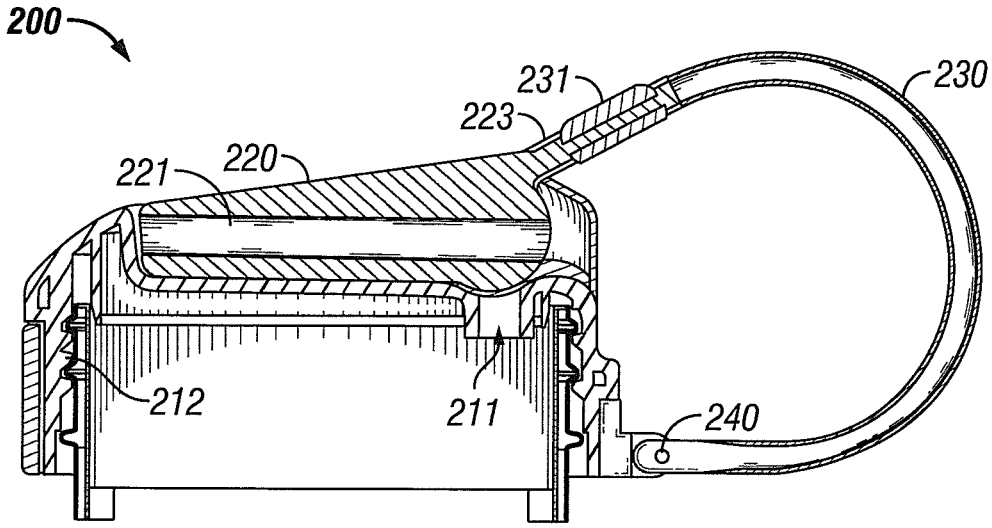
FIGS. 2A and 2B include a side cross-sectional view and a top view, respectively, of the lid of FIG. 1.
Figure 2B:
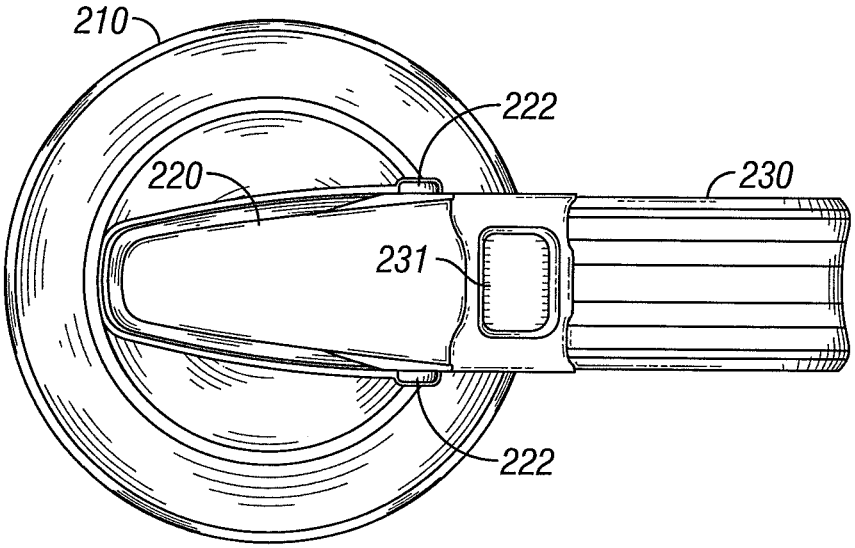
Figure 3:
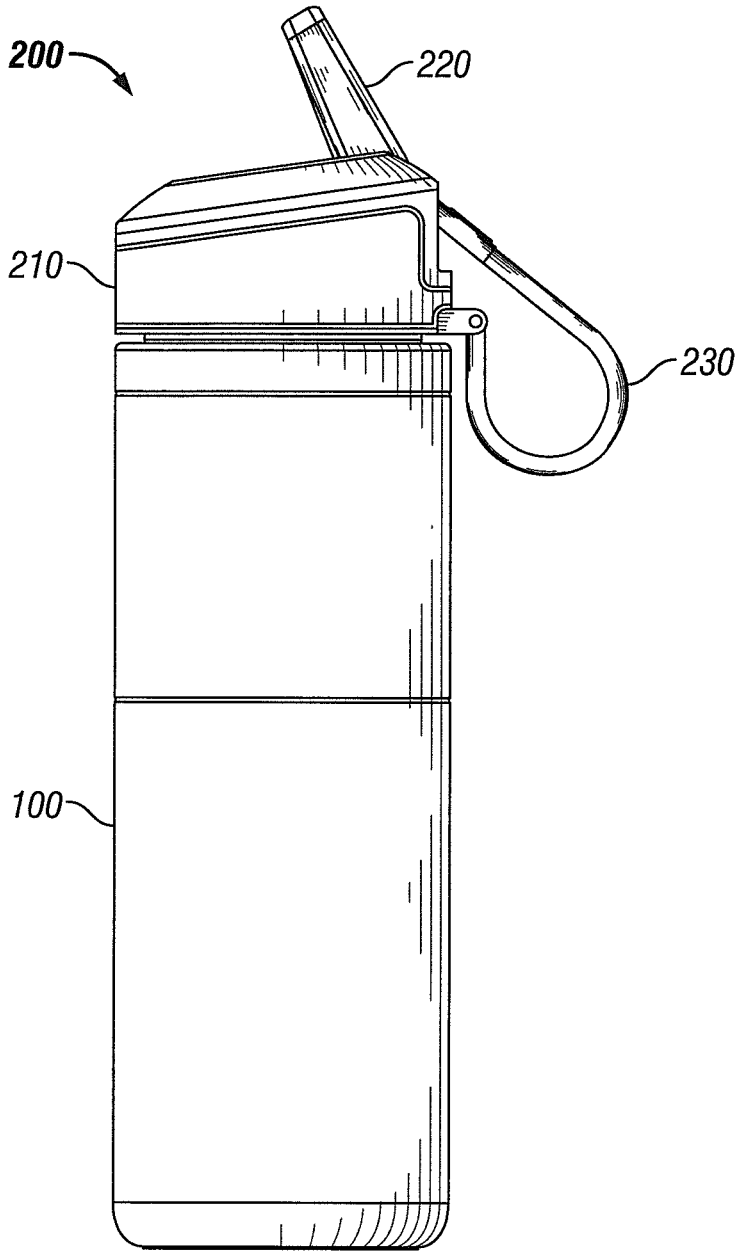
FIG. 3 is a side view of a container coupled to a lid with a rotatable sipping member in a released position.

FIG. 1 is a perspective view of a container 100 coupled to a lid 200 with a rotatable sipping member 220 in a stowed position, and FIGS. 2A and 2B include a side cross-sectional view and a top view, respectively, of the lid 200 with the rotatable sipping member 220 in the stowed position. FIG. 3 is a side view of the container 100 coupled to the lid 200 with the rotatable sipping member 220 in a released position, and FIGS. 4A and 4B include a side cross-sectional view and a front view, respectively, of the lid 200.

As shown in FIGS. 1 and 2A-2B, the lid 200 can reversibly couple to a container 100 operable to contain a fluid (e.g., liquid). The container 100 can include a base coupled to a plurality of upwardly extending walls forming an opening at an upper end of the container 100, as will be generally known in the art. The container 100 can be formed of various materials, including, for instance, metallic materials such as stainless steel, plastic-based materials, ceramic-based materials, or the like. The container 100 can include, for instance, a single- or double-walled structure. The container 100 can be shaped in any suitable manner, such as cylindrical as shown in FIG. 1.

The lid 200 can couple to the upper end of the container 100, covering the opening of the container 100. The lid 200 can include a body 210. The body 210 can be formed of various materials, such as plastic-based materials including, for example, polypropylene (PP) or the like. The body 210 can include an opening 211 formed therethrough. The opening 211 can be disposed in the body 210 such that the opening 211 is in fluid communication with the interior of the container 100, allowing a fluid disposed inside the container 100 to exit the container 100 via the opening 211 (e.g., as a user drinks through the lid). In some embodiments, the opening 211 can be formed at a location offset from a center of the body 210, as shown in FIG. 2A.

The body 210 can further include a thread pattern 212 formed thereon for reversibly mating the lid 200 to the container 100. The thread pattern 212 can be disposed on an internal surface of the body 210, as shown in FIG. 2A, so as to engage with a corresponding thread pattern disposed on an external surface of the container 100. Alternatively, the thread pattern 212 can be formed on an external surface of the body 210 so as to engage with a corresponding thread pattern disposed on an internal surface of the container 100.

Figure 4B:
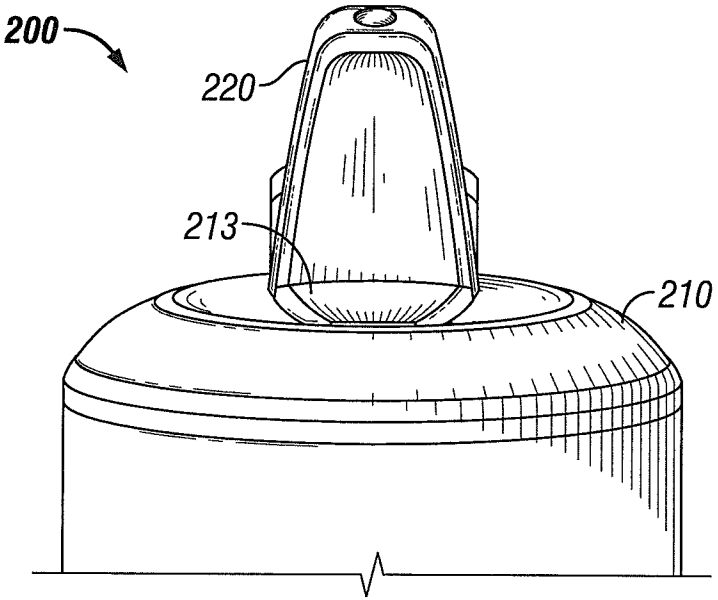
FIGS. 4A and 4B include a side cross-sectional view and a front view, respectively, of the lid of FIG. 3.
Figure 4A:
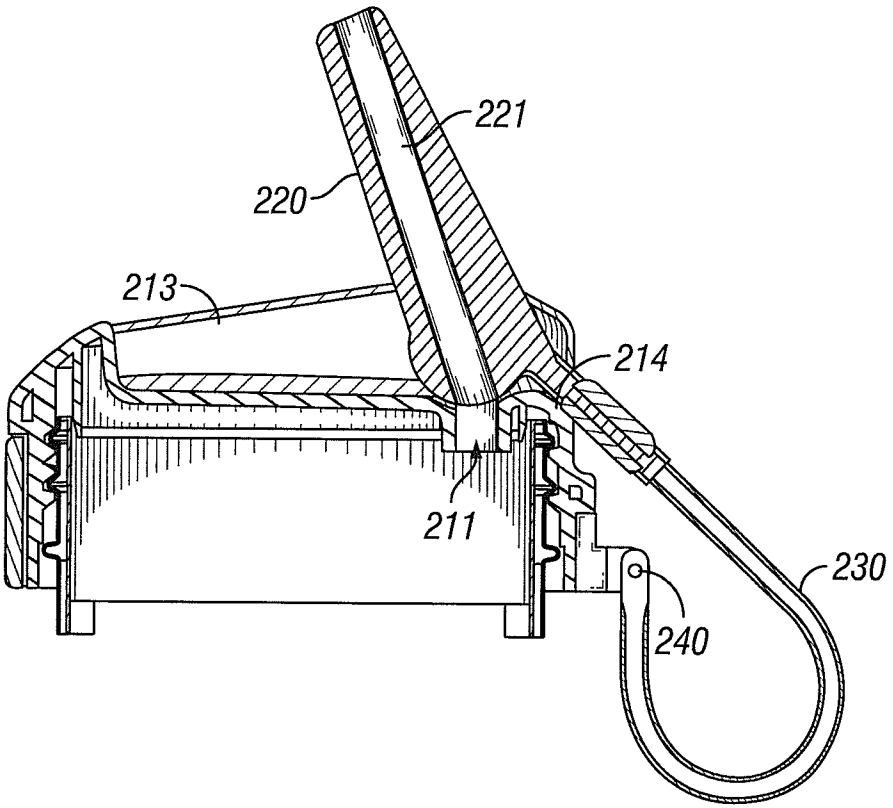

In addition, the body 210 can include an indentation portion 213 formed into an upper surface of the body 210. In some embodiments, as shown in FIGS. 4A and 4B, the indentation portion 213 can be formed along a center line of the upper surface of the body 210. The lower surface of the indentation portion 213 can be substantially parallel with the base of the container 100, or can be formed with a sloped surface, that is angularly offset from the base of the container 100, as shown in FIG. 4A. Also, in some embodiments, the opening 211 can be disposed inside of the indentation portion 213 at a bottom portion thereof.

The lid 200 can additionally include a sipping member 220 rotatably coupled to the body 210. Like the body 210, the sipping member 220 can be formed of various materials, such as plastic-based materials including, for example, PP or the like. A passageway 221 can be formed through an interior of the sipping member 220 so as to extend from a proximal end of the sipping member 220 to a distal end of the sipping member 220. For the purpose of the present disclosure, the proximal end of the sipping member 220 can correspond to the end of the sipping member 220 configured to come into contact with the opening 211 of the body 210. The distal end, by contrast, can correspond to the opposite end of the sipping member 220 engaged by a user while drinking through the sipping member 220.

The indentation portion 213 of the body 210 can define an interior receiving space configured to receive at least a portion of the sipping member 220. Particularly, when the sipping member 220 is disposed in a stowed position against the body 210 of the lid 200, as shown in FIGS. 1 and 2A-2B, the sipping member 220 can at least partially fit inside of the receiving space of the indentation portion 213 such that an upper surface of the sipping member 220 is substantially flush with an upper surface of the body 210. As a result, the sipping member 220 can be stowed conveniently against the body 210 when not in use (e.g., during transport of the container 100).

The indentation portion 213 can be formed with space enabling a portion of the sipping member 220 to rotate inside of the indentation portion 213. In this regard, the sipping member 220 can be coupled to the body 210 via support arms 222 extending outwardly from opposite sides of the sipping member 220, respectively, and attaching to the body 210, as shown in FIG. 2B. The indentation portion 213 can define support arm receiving spaces configured to receive the support arms 222. The support arm receiving spaces of the indentation portion 213 can permit the support arms to rotate therewithin. As a result, the sipping member 220 can rotate about the support arms 222. In some embodiments, the support arms 222 can be integral with the sipping member 220. That is, the sipping member 220 and the support arms 222 can be made of the same material so as to form a singular structure.

The lid 200 can further include a handle 230 for use when the user wishes to carry the container. The handle 230 can be formed of various flexible materials, such as, for example, a silicon-based material, a thermoplastic rubber-based material, or the like. The flexibility of the handle 230 can permit the handle 230 to be deformed in various shapes, as described below.

The handle 230 can be connected at a first end thereof to the sipping member 220 and rotatably coupled at a second end thereof to the body 210 via a pivot pin 240. When the lid 200 is oriented in an upright manner, as shown in FIGS. 2A and 4A, the first end of the handle 230 connected to the sipping member 220 can be positioned above the second end of the handle 230 coupled to the to the body 210 via the pivot pin 240. The handle 230 can extend outwardly from the lid 200 so as to form a carrying space inside of the handle 230 through which the user can insert one or more fingers for carrying the lid 200 and container 100 (when the container 100 and lid 200 are mated together).

In some embodiments, the first end of the handle 230 can be co-injected with a portion of the sipping member 220. That is, the respective materials of the sipping member 220 and handle 230 can be formed through injection into the same mold such that the sipping member 220 and handle 220 are attached to each other. The portion of the sipping member 220 with which the handle 230 is co-injected can correspond to an outwardly extending arm 223 disposed at or proximate to the proximal end of the sipping member 220, as shown in FIGS. 2A and 4A.

In some embodiments, the handle 230 can include a protrusion portion 231 disposed at the first end thereof, adjacent to the sipping member 220. The protrusion portion 231 can be formed with a surface level raised above that of an adjacent portion of the handle 230. The protrusion portion 231 can further be formed with a textured upper surface, enhancing the user's ability to grip the upper portion of the handle 230. Furthermore, as a result of the co-injection, the upper surface of the protrusion portion 231 can be surrounded entirely by a portion of the sipping member 220, as shown in FIG. 2B, thus enhancing the visibility of the protrusion portion 231.

The handle 230 and the sipping member 220 can be coupled together in such a manner that certain user interaction with the handle 230 causes rotation of the sipping member 220. In this regard, the sipping member 220 can be configured to rotate between, at least, a stowed position and a released position. Of course, the sipping member 220 can freely rotate to any position between the stowed position and the released position.

As shown in FIG. 2A, when the sipping member 220 is in the stowed position, the passageway 221 of the sipping member 220 and the opening 211 of the body 210 can be misaligned, such that the opening 211 is sealed, preventing spillage of fluid contained within the container 100. In the stowed position, a portion of the body of the sipping member 220 can seal the opening 211 of the body 210. The proximal end of the sipping member 220 can be circularly shaped so as to enable rotation of the sipping member inside of the indentation portion 213, as shown in FIG. 2A. Various portions of the circularly shaped proximal end of the sipping member 220 can operate to seal the opening 211. As such, the top of the opening 211 can be shaped in a manner corresponding to the shape of the circularly shaped proximal end of the sipping member 220, allowing the top of the opening 211 to come into contact with the sipping member 220 as it rotates.

As shown in FIG. 4A, when the sipping member 220 is in the released position, the passageway 221 of the sipping member 220 and the opening 211 can be aligned, allowing a user to drink therethrough. In the released position, the passageway 221 and the opening 211 can define a fluid path through which a fluid disposed in the interior of the container 100 can exit the container 100. By contrast, the fluid path defined by the passageway 221 and the opening 211 can be obstructed by the body of the sipping member 220 in the stowed position, preventing said fluid from leaking through the lid 200.

The body 210 of the lid 200 can include a stopping portion 214 configured to prevent the sipping member 220 from rotating beyond the released position, that is, rotating further in a direction opposite of the stowed position. In this regard, a portion of the sipping member 220 and/or a portion of the handle 230 can come into contact with an outer surface, i.e., stopping portion 214, of the body 210 when the sipping member 220 rotates into the released position. The stopping portion 214 can stop the sipping member 220 from rotating beyond such position.

As noted above, manipulation of the handle 230 can cause rotation of the sipping member 220 attached thereto. In this regard, the handle 230 can be configured such that a substantially downward force exerted on the handle 230 causes rotation of the sipping member 220 toward the released position (see, e.g., FIGS. 3, 4A and 4B). A user can apply a substantially downward force on the handle 230 by, for example, pressing downwardly on an upper region of the handle 230. The user can release the sipping member 220 from the stowed position by pressing down on the protrusion portion 231, as an example. Additionally, the user can rotate the sipping member 220 by pushing, pulling, or otherwise interacting with the handle 230 in a manner which generates a substantially downward force upon the handle 230. Thus, the user can conveniently release the sipping member 220 from the stowed position through a substantially downwardly directed interaction with the handle 230.

In addition to rotation of the sipping member 220, the substantially downward force exerted on the handle 230 described above can also cause rotation of the handle 230 about the pivot pin 240. In one example, rotation of the sipping member 220 from the stowed position to the released position can cause the handle 230 to rotate about the pivot pin 240 approximately 90 degrees. Rotation of the sipping member 220 from the released position to the stowed position can cause the handle 230 to rotate about the pivot pin 240 approximately 90 degrees in the opposite direction.

As mentioned above, the handle 230 in conjunction with an outer portion of the body 210 can define a carrying space therein through which the user can insert one or more fingers for carrying the lid 200. In some cases, the size and shape of the carrying space defined inside of the handle 230 can be modified due to the flexibility of the handle 230, such as in response to rotation of the sipping member 220 and handle 230. For example, when the sipping member 220 is rotated from the released position to the stowed position, the size of the carrying space as defined by the handle 230 and the outer portion of the body 210 can increase, as demonstrated in FIG. 1 in relation to FIG. 3. Conversely, when the sipping member 220 is rotated from the stowed position to the released position, the size of the carrying space can decrease as the handle 230 flexes in response to such rotation.

Meanwhile, a substantially upward or lateral (i.e., sideways) force can be exerted on the handle 230 when the user is carrying the lid 200 by the handle 230, e.g., during transport of the container 100. In such case, the handle 230 can be configured such that, when the sipping member 220 is in the stowed position, as shown in FIGS. 1, 2A and 2B, the sipping member 220 can remain stowed in response to the substantially upward or lateral force exerted on the handle 230. Therefore, the lid 200 and container 100 can be carried by the handle 230, while the sipping member 220 is stowed, without inadvertent release of the sipping member 220.

Accordingly, the container lid with a rotatable sipping member ("sipper") and flexible handle disclosed herein enables a user to stow the sipper when its presence is unnecessary or unwanted. A simple substantially downward force exerted on the handle can cause release (rotation) of the sipper away from the stowed position, allowing a user to drink through the sipper. However, when the sipper is stowed away, a user can carry the lid by the handle without the sipper releasing.

The foregoing description has been directed to embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A container lid comprising:

a body having an opening formed therethrough and a thread pattern formed thereon for reversibly mating the container lid to a container, the opening in fluid communication with an interior of the container;

a sipping member rotatably coupled to the body, said sipping member formed of a first material, a passageway formed through an interior of the sipping member so as to extend from a proximal end of the sipping member to a distal end of the sipping member, the sipping member configured to rotate between a stowed position in which the passageway and the opening are misaligned, such that the opening is sealed, and a released position in which the passageway and the opening are aligned; and a handle connected at a first end to the sipping member and rotatably coupled at a second end to the body via a pivot pin, the handle being formed of a second flexible material different than said first material, said second flexible material being co-injected with said first material, wherein the handle is configured such that a substantially downward force exerted on the handle causes rotation of the sipping member toward the released position, wherein rotation of the sipping member from the released position to the stowed position increases a shortest linear distance between the first end of the handle and the second end of the handle.

2. The container lid of claim 1, wherein the handle is configured such that, when the sipping member is in the stowed position, the sipping member remains in the stowed position in response to a substantially upward or lateral force exerted on the handle.

3. The container lid of claim 1, wherein, when the sipping member is in the released position, the passageway of the sipping member and the opening define a fluid path through which a fluid disposed in the interior of the container can exit the container.

4. The container lid of claim 3, wherein, when the sipping member is in the stowed position, the fluid path defined by the passageway of the sipping member and the opening is obstructed.

5. The container lid of claim 1, wherein, when the sipping member is in the stowed position, the opening is sealed by a portion of a body of the sipping member.

6. The container lid of claim 1, wherein the handle is configured such that the substantially downward force exerted on the handle further causes rotation of the handle about the pivot pin.

7. The container lid of claim 1, wherein rotation of the sipping member from the stowed position to the released position causes the handle to rotate about the pivot pin approximately 90 degrees.

8. The container lid of claim 1, wherein, when the sipping member is in the released position, at least one of a portion of the sipping member and a portion of the handle is configured to come into contact with an outer surface of the body, preventing further rotation of the sipping member away from the stowed position.

9. The container lid of claim 1, wherein the first end of the handle is co-injected with a portion of the sipping member.

10. The container lid of claim 1, wherein the first end of the handle includes a protrusion portion having a surface level raised above that of an adjacent portion of the handle.

11. The container lid of claim 10, wherein an upper surface of the protrusion portion is surrounded entirely by a portion of the sipping member.

12. The container lid of claim 1, wherein the first end of the handle is positioned above the second end of the handle when the container lid is oriented in an upright manner.

13. The container lid of claim 1, further comprising an indentation portion formed into an upper surface of the body, the indentation portion defining an interior receiving space configured to receive a portion of the sipping member.

14. The container lid of claim 13, further comprising support arms extending outwardly from opposite sides of the sipping member, respectively, and disposed at least partially inside of the indentation portion, wherein the sipping member is rotatably coupled to the body via the support arms such that the sipping member is configured to rotate about the support arms.

15. The container lid of claim 14, wherein the support arms are integral with the sipping member.

16. The container lid of claim 14, wherein the indentation portion further defines support arm receiving spaces configured to receive the support arms.

17. The container lid of claim 13, wherein, when the sipping member is in the stowed position, the indentation portion is configured to receive the sipping member such that an upper surface of the sipping member is substantially flush with an upper surface of the body.

18. The container lid of claim 1, wherein the thread pattern is formed on an interior surface of the body.

19. The container lid of claim 1, wherein the sipping member is made of a polypropylene-based material, and the handle is made of a silicon-based material or a thermoplastic rubber-based material.

* * * * *